US006964578B2

(12) United States Patent
Clark et al.

(10) Patent No.: US 6,964,578 B2
(45) Date of Patent: Nov. 15, 2005

(54) CABLE CONNECTOR RETAINING ASSEMBLY, SYSTEM, AND METHOD OF ASSEMBLING SAME

(75) Inventors: Mark Garrison Clark, Rochester, MN (US); Ray Clement Laning, Kasson, MN (US); Christopher Michael Marroquin, Rochester, MN (US); Brian Joseph Stanczyk, Rochester, MN (US); Randall Vincent Tointon, Rochester, MN (US)

(73) Assignee: International Business Machines Corporation, Armonk, NY (US)

( * ) Notice: Subject to any disclaimer, the term of this patent is extended or adjusted under 35 U.S.C. 154(b) by 44 days.

(21) Appl. No.: 10/193,540

(22) Filed: Jul. 11, 2002

(65) Prior Publication Data

US 2004/0009697 A1 Jan. 15, 2004

(51) Int. Cl.[7] ..... H01R 13/62
(52) U.S. Cl. ..... 439/320; 439/310; 439/362
(58) Field of Search ..... 439/310, 362, 439/365, 446, 320

(56) References Cited

U.S. PATENT DOCUMENTS 5,098,312 A * 3/1992 Raczynski ..... 439/362
5,100,341 A * 3/1992 Czyz et al. ..... 439/447
5,197,900 A * 3/1993 Ellis et al. ..... 439/352
5,324,209 A * 6/1994 Falossi et al. ..... 439/362
5,658,170 A 8/1997 Tan et al.
5,876,233 A 3/1999 Choudhury et al.
6,475,021 B1 * 11/2002 Tan et al. ..... 439/466
6,544,062 B1 * 4/2003 Loveless et al. ..... 439/362

* cited by examiner

*Primary Examiner*—Briggitte R. Hammond
(74) *Attorney, Agent, or Firm*—Matthew J. Bussan

(57) ABSTRACT

A cable connector retaining system includes a cable connector retaining assembly having a connector block and a movable retention block with a connector retention fastener, e.g., a threaded fastener. The system also includes a plate having a connector mounted thereon and a connector retention feature, e.g., a threaded hole, positioned adjacent to the connector. The connector block has a connector housed in an overmold jacket and connectable to the plate's connector. The connectors may be USB-type connectors, for example. The retention block is movably mounted to the connector block's overmold jacket so that the retention block's connector retention fastener may be aligned with the plate's connector retention feature. Once aligned, the connector retention fastener may be engaged with the connection retention feature. Movement of the retention block allows a single cable connector retaining assembly to be used for multiple plate configurations (i.e., with the connector retention feature at different positions).

23 Claims, 6 Drawing Sheets

CABLE CONNECTOR RETAINING ASSEMBLY, SYSTEM, AND METHOD OF ASSEMBLING SAME

FIELD OF THE INVENTION

The present invention relates in general to electronic and fiber optic cable connectors and connector systems. More particularly, the present invention relates to a cable connector retaining assembly, system, and a method of assembling the same.

BACKGROUND

The development of the EDVAC computer system of 1948 is often cited as the beginning of the computer era. Since that time, computer systems have evolved into extremely sophisticated devices, and computer systems may be found in many different environments. Since the dawn of the computer age, cables have been used to transfer data between computers and input/output devices, and between computers. For example, cables are used in input/output (I/O) device attachment applications, such as disk drive, tape drive, mouse, keyboard, printer, scanner, camera, and personal data assistant (PDA) attachment. Cables are also used in networking applications, such as local-area networks (LANs) and wide-area networks (WANs).

Cables typically include a connector at each end that is plugged into a corresponding connector of a connector port associated with the computer or I/O device. Such connectors are well known in the connector art and include electronic connectors and fiber optic connectors. Some common electronic connectors, include universal serial bus (USB)-type connectors, parallel connectors and serial connectors, for example. Some common fiber optic connectors, include LC, ST, SC, and MTP optical connectors (also known as MPO connectors), for example.

Cable connector retaining systems are typically employed to reduce the likelihood that a cable connector will be unintentionally unplugged from a connector port. For example, parallel connectors and serial connectors are typically mounted on a plate having connector retention features, e.g., threaded holes, formed therein on each end of the connector. The connector retention features of the plate accommodate connector retention fasteners, e.g., threaded fasteners, attached to or incorporated into a portion of a cable connector retaining assembly. The threaded fasteners pull the cable connector into plate's connector, and maintain reliable, continuous contact between electrical contacts of the cable connector and electrical contacts of the plates's connector.

Different plate configurations, i.e., plates having the threaded holes located at different positions relative to the connector, may be desirable depending on the circumstances. For example, it may be desirable to locate the threaded holes above and/or below the connector, rather than on each end of the connector, to more efficiently use the available space. Also, it may be desirable to omit one or more of the threaded holes between adjacent connectors to more densely pack the connectors next to each other. Unfortunately, such an alternative plate configurations typically require one end of a cable to be terminated in a cable connector retaining assembly having a correspondingly alternative configuration. This undesirably increases the difficulty of maintaining an inventory of cables necessary for connecting various computers and I/O devices.

Cable connector retaining systems also are typically employed in USB-type connectors. Typically, a USB-type receptacle connector includes a conductive shell that surrounds a support with contacts that are exposed in a space between the support and the conductive shell. A USB-type cable connector assembly typically includes a conductive shell that surrounds a plug section with contacts exposed in a space between the plug section and the conductive shell. As the cable connector assembly is plugged into the receptacle connector, the contacts make mechanical and electrical contact. Typically, one or more spring tangs of the conductive shell of the receptacle connector are received within one or more indents of the conductive shell of the cable connector assembly to reduce the likelihood that a cable connector assembly will be unintentionally unplugged from a receptacle connector. This type of cable connector retaining system is typically less reliable than those of parallel connectors and serial connectors due to the small size of, and force exerted by, the spring tangs.

Therefore, there exists a need to provide an enhanced cable connector retaining assembly, system, and a method of assembling the same.

SUMMARY OF THE INVENTION

An object of the present invention is to provide an enhanced cable connector retaining assembly, system, and method of assembling the same, that addresses these and other problems associated with the prior art.

These and other objects of the present invention are achieved by providing a cable connector retaining system that includes a cable connector retaining assembly having a connector block and a movable retention block with a connector retention fastener, e.g., a threaded fastener. The system also includes a plate having a connector mounted thereon and a connector retention feature, e.g., a threaded hole, positioned adjacent to the connector. The connector block has a connector at least partially housed in an overmold jacket and connectable to the plate's connector. The connectors may be USB-type connectors, for example. The retention block is movably mounted to the connector block's overmold jacket so that the retention block's connector retention fastener may be aligned with the plate's connector retention feature. Once aligned, the connector retention fastener may be engaged with the connection retention feature. Movement of the retention block allows a single cable connector retaining assembly to be used for multiple plate configurations (i.e., plates having the connector retention feature located at different positions relative to the connector).

BRIEF DESCRIPTION OF THE DRAWINGS

The present invention together with the above and other objects and advantages can best be understood from the following detailed description of the embodiments of the invention illustrated in the drawings, wherein like reference numerals denote like elements.

DETAILED DESCRIPTION OF THE PREFERRED EMBODIMENTS

Overview

The present invention utilizes a cable connector retaining assembly having a retention block moveable mounted to a connector block. The retention block has a connector retention fastener to maintain a reliable, continuous connection. The connector retention fastener may be any suitable fastener including a threaded fastener, a snap-in fastener, a latch fastener, or the like. Movement of the retention block allows a single cable connector retaining assembly to be used in multiple configurations. Preferably, the retention block is rotatably mounted to the connector block so that the retention block and its connector retention fastener are movable anywhere on a radius 360° about the connector block.

A cable connector retaining system, for example, consistent with the present invention includes a cable connector retaining assembly having a connector block and a movable retention block with a connector retention fastener, e.g., a threaded fastener. The system also includes a plate having a connector mounted thereon and a connector retention feature, e.g., a threaded hole, positioned adjacent to the connector. The connector block has a connector at least partially housed in an overmold jacket and connectable to the plate's connector. The connectors may be USB-type connectors, for example. The retention block is movably mounted to the connector block's overmold jacket so that the retention block's connector retention fastener may be aligned with the plate's connector retention feature. Preferably, the retention block and its connector retention fastener are movable anywhere on a radius 360° about the connector block. Once aligned, the connector retention fastener may be engaged with the connection retention feature. Movement of the retention block allows a single cable connector retaining assembly to be used for multiple plate configurations (i.e., plates having the connector retention feature located at different positions relative to the connector).

Hardware Environment

Figure 1:
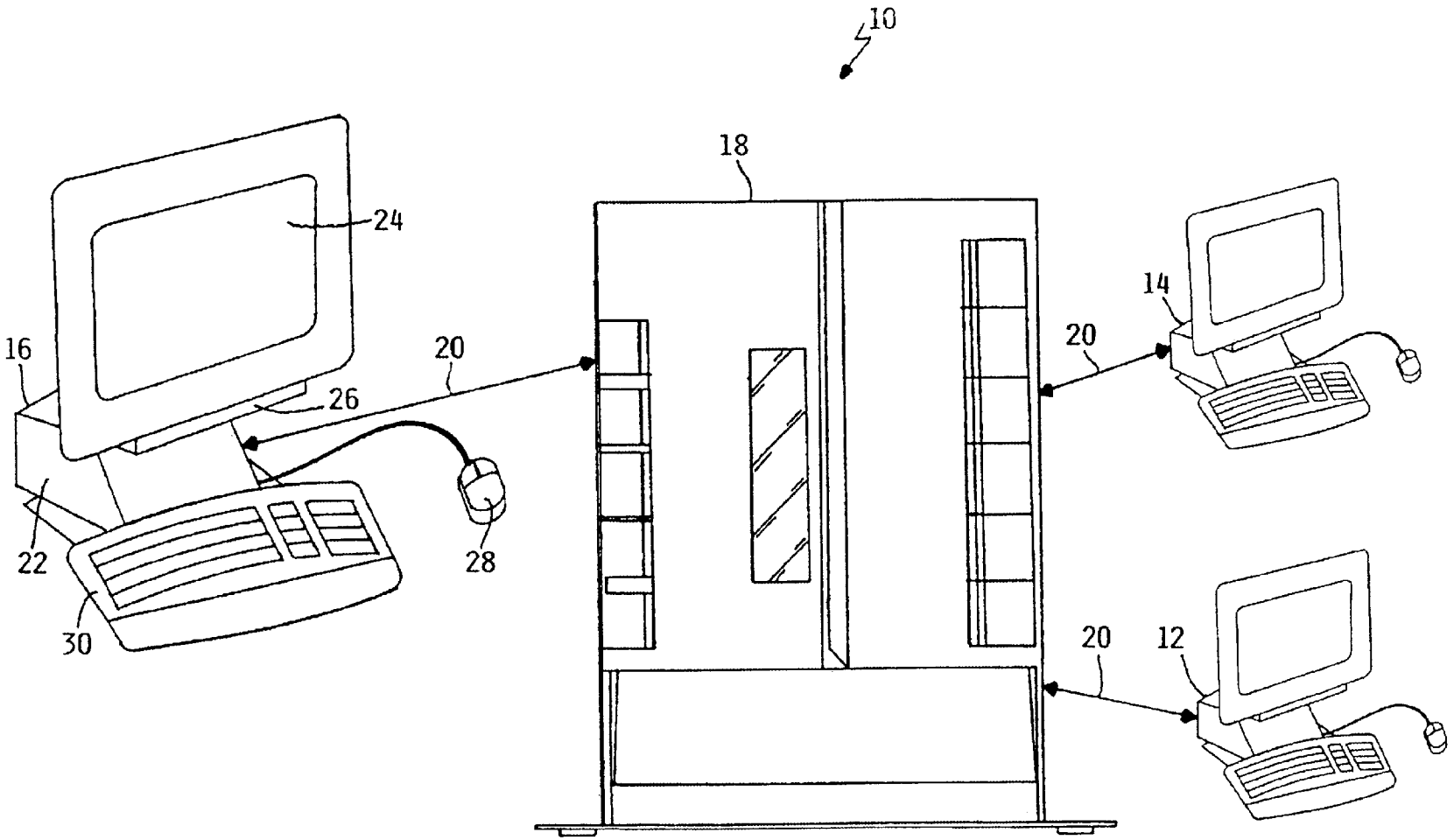
FIG. 1 is a block diagram of a networked computer system consistent with the present invention.

FIG. 1 illustrates a computer system 10 that is consistent with the present invention. Computer system 10 is illustrated as a networked computer system. Computer system 10 includes one or more client computers 12, 14 and 16 (e.g., desktop or PC-based computers, workstations, etc.) coupled to server computer 18 (e.g., a PC-based server, a minicomputer, a midrange computer, a mainframe computer, etc.) through a network 20. The server computer 18 may comprise a plurality of enclosures as an alternative to the single enclosure illustrated in FIG. 1. Network 20 may represent practically any type of networked interconnection. For example, network 20 may be a local-area network (LAN), a wide-area network (WAN), a wireless network, and a public network (e.g., the Internet). Moreover, any number of computers and other devices may be networked through the network 20, e.g., multiple servers. In one application of the present invention, server computer 18 and one or more of client computers 12, 14 and 16 may each include a connector port into which may be plugged a cable to form network 20 or a portion thereof. A cable connector retaining assembly according to the present invention may be employed at one or more ends of the cable. For example, a cable connector retaining assembly according to the present invention may be plugged into a connector port that is connected to an electronic circuit board of a networking adapter of the computer.

Client computer 16, which may be similar to client computers 12 and 14, may include a central processing unit (CPU) 22; a number of peripheral components such as a computer display 24; a storage device 26; and various input devices (e.g., a mouse 28 and a keyboard 30), among others. Server computer 18 may be similarly configured, albeit typically with greater processing performance and storage capacity, as is well known in the art. In another application of the present invention, input/output devices (e.g., disk drive, tape drive, mouse, keyboard, printer, scanner, camera, and PDA) and client computer 16 (or server computer 18) may each include a connector port into which may be plugged a cable that forms an interconnection (or a portion thereof) between the input/output devices and client computer 16 (or server computer 18). A cable connector retaining assembly according to the present invention may be employed at one or more ends of the cable. For example, a mouse having a cable connector retaining assembly according to the present invention may be plugged into a connector port that is connected to an electronic circuit board of an I/O adapter of the computer.

In yet another application of the present invention, various other electronic components of client computer 16 (or server computer 18) may each include a connector port into which may be plugged a cable that forms an interconnection (or a portion thereof) between the electronic components within a single computer enclosure and/or between a plurality of enclosures of the computer. A cable connector retaining assembly according to the present invention may be employed at one or more ends of the cable. For example, a cable connector retaining assembly according to the present invention may be plugged into a connector port that is connected to an electronic circuit board of each of such electronic components of the computer.

Although shown and described above in the environment of a computer, the present invention is not limited thereto. In general, a cable connector retaining assembly of the present invention may be used to provide an electronic or a fiber optic cable interconnection to any electrical devices or components.

Cable Connector Retaining Assembly, System and Method of Assembly

Figure 2:
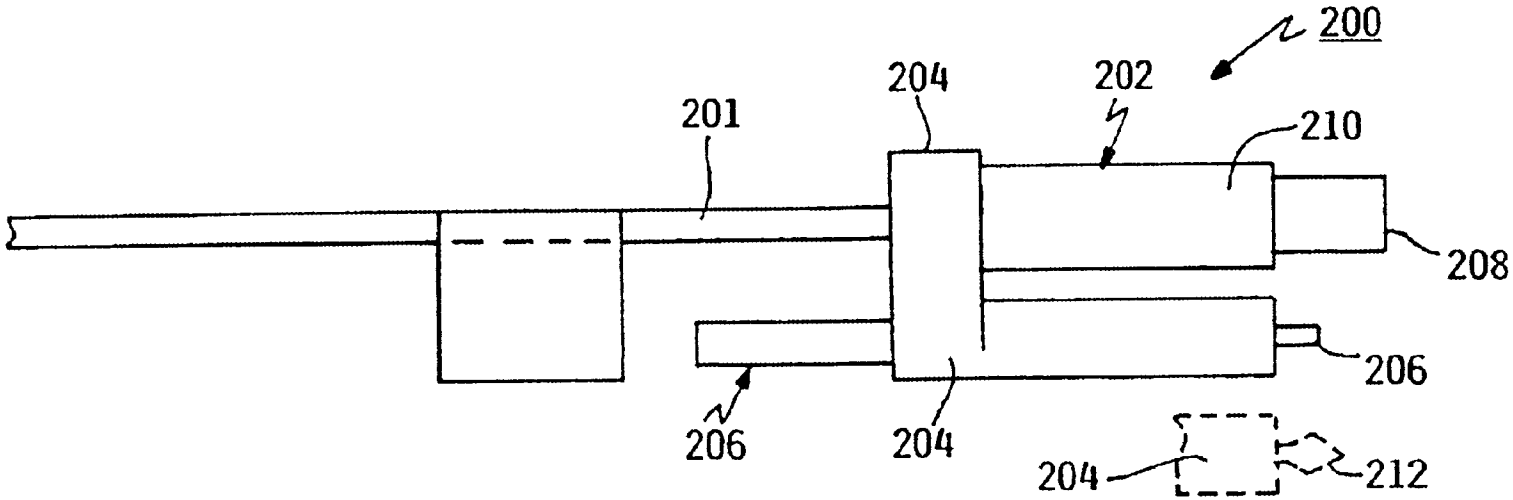
FIG. 2 is a top view of a cable connector retaining assembly according to an embodiment of the present invention.
Figure 4:
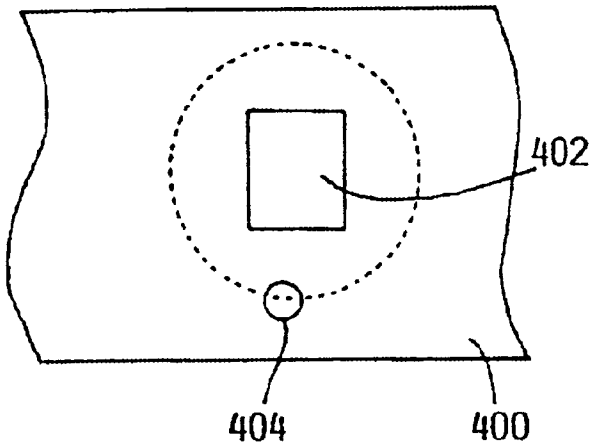
FIG. 4 is a front view of a plate having a connector and a threaded hole for cooperation with a cable connector retaining assembly according to the embodiment of the present invention shown in FIG. 2.
Figure 3:
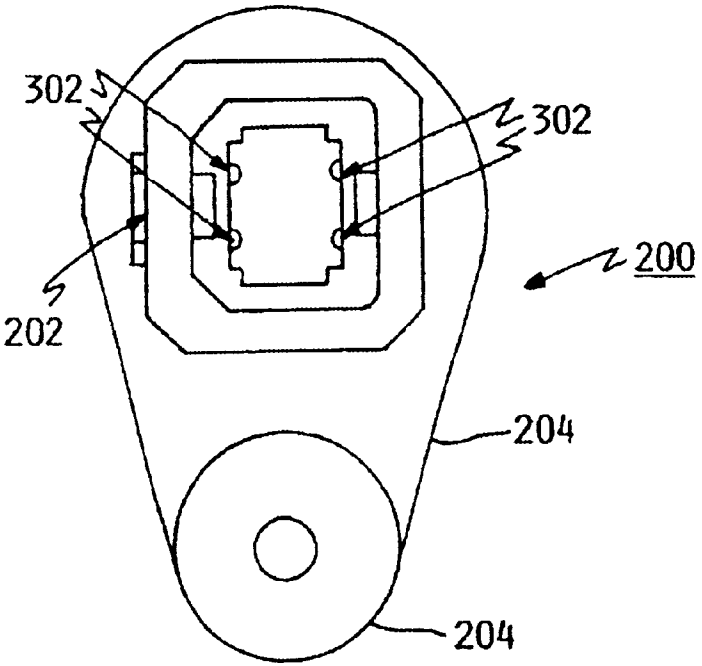
FIG. 3 is a front view of a cable connector retaining assembly according to the embodiment of the present invention shown in FIG. 2.

FIGS. 2 and 3 are respectively top and front views of a cable connector retaining assembly 200 of a cable connector retaining system according to an embodiment of the present invention. The cable connector retaining assembly 200 includes a cable 201, a connector block 202 and a rotatable retention block 204 with a connector retention fastener, e.g., a threaded fastener 206. As shown in FIG. 4, the cable connector retaining system also includes a plate 400 having a connector 402 mounted thereon and a connector retention feature, e.g., a threaded hole 404, positioned adjacent to connector 402 for cooperation with cable connector retaining assembly 200. Threaded fastener 206 and threaded hole 404 are shown as examples of suitable connector retention fasteners and features. Alternative arrangements and alternative connector retention fasteners/features may be used consistent with the present invention, which is not limited to the threaded fastener/threaded hole arrangement shown. For example, the connector retention fastener may include an internally threaded hole and the connector retention feature may include a threaded stud. Other suitable connector retention fasteners and features that may be used consistent with the present invention include snap-in fasteners/holes and squeezable latch fasteners/holes. For example, as shown in dotted lines in FIG. 2, a snap-in fastener 212 (in lieu of threaded fastener 206) may be mounted (preferably by insert molding) at the end of retention block 204 to engage a corresponding hole in plate 400.

Returning to FIGS. 2 and 3, connector block 202 includes a connector 208 at least partially housed in an overmold jacket 210 and connectable to the plate's connector 402. In this embodiment, as best seen in FIG. 3, connector 208 is a USB-type connector that includes four electrical contacts 302 that make electrical contact with corresponding contacts (not shown) in the plates's connector 402. However, the USB-type connector is shown for the purpose of illustration. The present invention is not limited to use with the particular USB-type connector configuration shown, USB-type connectors, or even electrical cable connectors. The connectors may be any type of fiber optic and/or electronic cable connectors. Some common electronic connectors that may be used consistent with the present invention include parallel connectors and serial connectors, in addition to universal serial bus (USB)-type connectors. Some common fiber optic connectors that may be used consistent with the present invention include LC, ST, SC, and MTP optical connectors (also known as MPO connectors).

The retention block 204 is rotatably mounted to overmold jacket 210 of connector block 202 so that the connector retention fastener of retention block 204 (e.g., threaded fastener 206) may be aligned with the connection retention feature of plate 400 (e.g., threaded hole 404). Preferably, retention block 204 and its connector retention fastener (e.g., threaded fastener 206) are movable anywhere on a radius 360° about connector block 202. Once aligned, the connector retention fastener of retention block 204 (e.g., threaded fastener 206) may be engaged with the connection retention feature of plate 400 (e.g., threaded hole 404). Rotation of the retention block 204 allows a single cable connector retaining assembly 200 to be used for multiple plate configurations, i.e., plates 400 having the connection retention feature (e.g., threaded hole 404) located at different positions (shown as a dotted circle in FIG. 4) relative to connector 402. It should be understood that the retention block may be movably mounted so as to allow other types of movement. For example, it may be desirable to movably mount the retention block for linear motion or elliptical motion in lieu of circular motion. It should also be understood that the retention block need not be configured as shown in FIG. 2. For example, the retention block may configured to extend on one or more additional sides of the connector block and include an additional connector retention fastener at each such extension.

The retention block 204 and overmold jacket 210 may be constructed of any durable material. Although polymeric materials are preferred, metallic materials may also be used, or combinations thereof. Suitable polymeric materials for retention block 204 and overmold jacket 210 include polyvinyl chloride (PVC) and polycarbonate. Retention block 204 and overmold jacket 210 may be molded, machined or extruded. Preferably, retention block 204 and overmold jacket 210 are molded polymeric materials. The overmold jacket 210 may be over-molded on a pre-assembly of cable 201 and connector 208 using a conventional insert molding process whereby a polymeric material is injected into a mold that surrounds the pre-assembly and is then cured.

The threaded fastener 206 and plate 400 may be constructed of any wear resistant material. Metallic materials, polymeric materials, or a combination thereof may be used. Preferably, the shaft of threaded fastener 206 is constructed from a metallic material to which is attached a thumb cap constructed of a polymeric material, preferably glass filled nylon. The plate 400 is preferably constructed from a sheet of metallic material. The threaded fastener 206 and plate 400 may be molded, machined or extruded. The snap-in fastener 212, if used in lieu of threaded fastener 206, is preferably constructed of a resilient metallic material or a resilient polymeric material.

Figure 5:
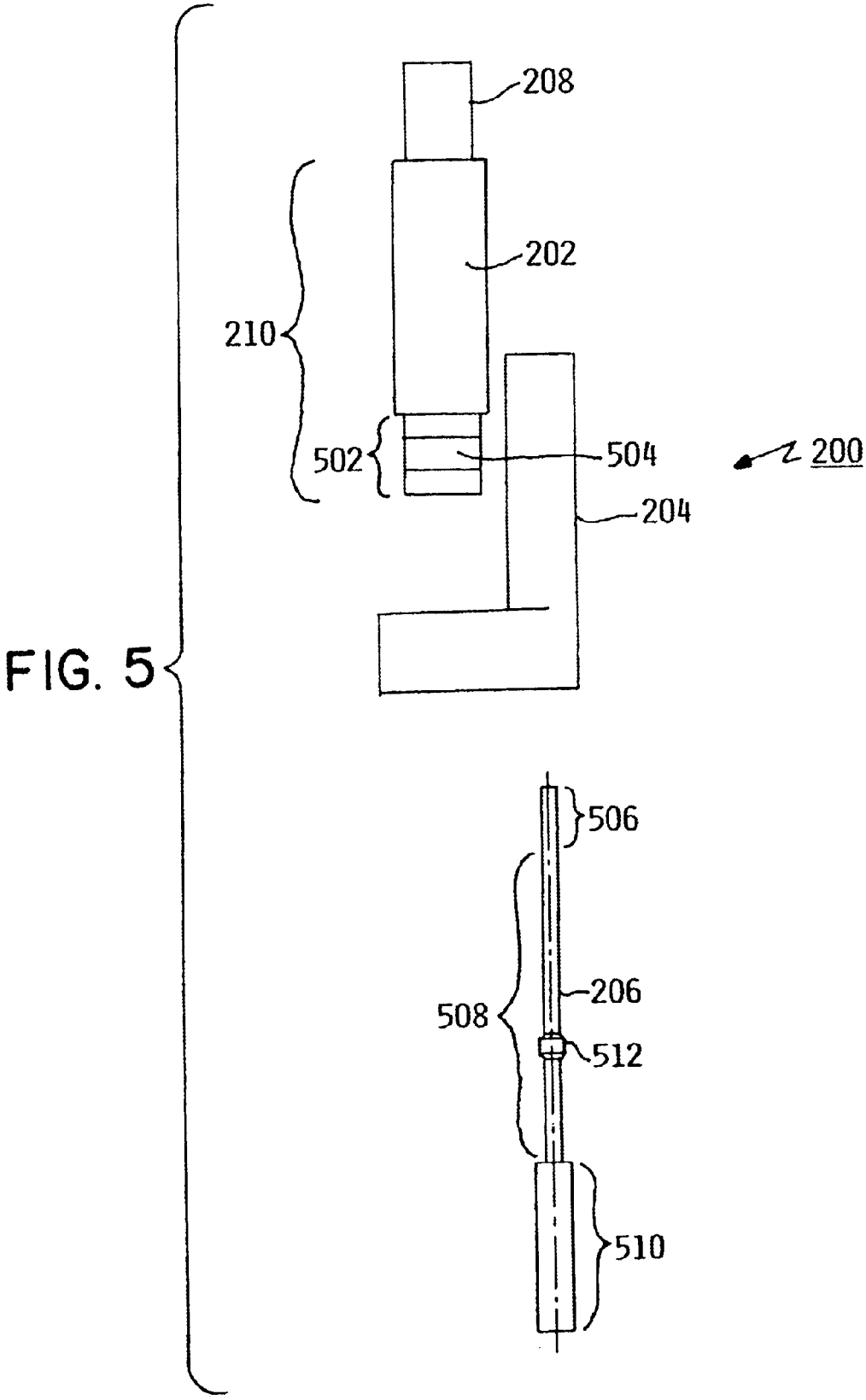
FIG. 5 is an exploded top view showing a connector block, a retention block and a threaded fastener of a cable connector retaining assembly according to the embodiment of the present invention shown in FIG. 2.
Figure 6:
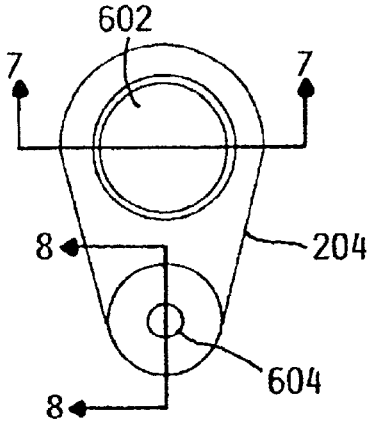
FIG. 6 is a front view of the retention block shown in FIG. 5.
Figure 7:
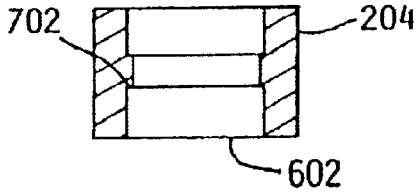
FIG. 7 is a partial sectional view of the retention block shown in FIG. 6 that shows a hole for receiving the connector block.

FIG. 5 is an exploded top view showing connector block 202, retention block 204 and threaded fastener 206 of cable connector retaining assembly 200. The overmold jacket 210 of connector block 202 includes a sleeve portion 502 through which cable 201 (not shown in FIG. 5) passes. The sleeve portion 502 of overmold jacket 210 is rotatably received in a hole 602 (shown in FIG. 6) in retention block 204. FIG. 6 is a front view of the retention block 204, with the connector block and the threaded fastener removed. The sleeve portion 502 of overmold jacket 210 has a generally cylindrical outer surface with a groove 504 that rotatably secures a raised area 702 (shown in FIG. 7) of hole 602 in retention block 204. FIG. 7 is a partial sectional view of retention block 204 along section E—E shown in FIG. 6. The raised area 702 of hole 602 in retention block 204 preferably has one or more tapered edges so that retention block 204 may readily be snapped onto (and perhaps off of) sleeve portion 502 of connector block 202. It should be understood that raised area 702 and groove 504 may be reversed with respect to the elements on which they are formed.

Figure 8:
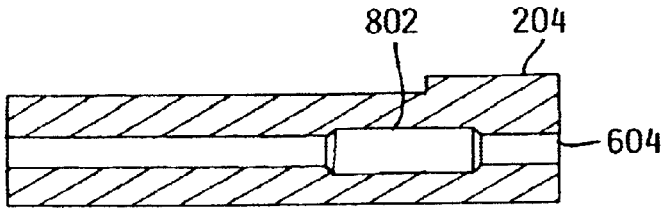
FIG. 8 is a partial sectional view of the retention block shown in FIG. 6 that shows a hole for receiving the threaded fastener.

Returning now to FIG. 5, threaded fastener 206 includes a threaded portion 506, a cental portion 508, and a thumb hold portion 510. The threaded fastener 206 is rotatably received in a hole 604 (shown in FIG. 6) in retention block 204. The central portion 508 of threaded fastener 206 has a generally cylindrical outer surface with a raised area 512 that is rotatably secured a valley 802 (shown in FIG. 8) of hole 604 in retention block 204. FIG. 8 is a partial sectional view of the retention block 204 along section D—D shown in FIG. 6. The raised area 512 of threaded fastener 206 preferably has one or more tapered edges so that threaded fastener may readily be snapped into (and perhaps out of) hole 604 in retention block 204. It should be understood that raised area 512 and valley 802 may be reversed with respect to the elements on which they are formed.

Figure 9:
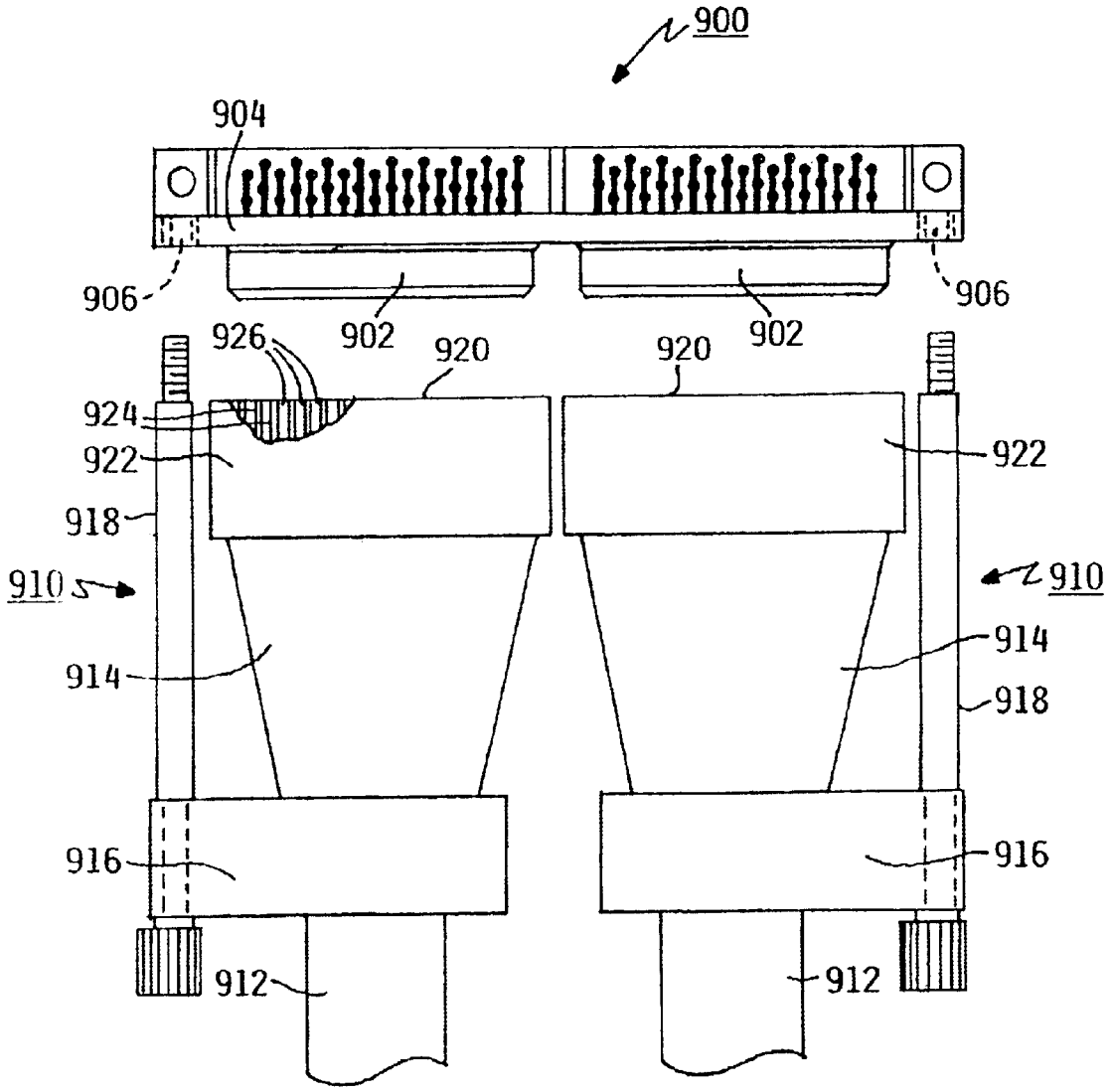
FIG. 9 is an exploded top view of a cable connector retaining system according to another embodiment of the present invention.

FIG. 9 is an exploded top view of a cable connector retaining system 900 according to another embodiment of the present invention. Two parallel port connectors 902 are mounted side-by-side on a plate 904. The plate 904 includes two threaded holes 906, one adjacent to each connector 902. In conventional arrangements, threaded holes are typically included on each end of each connector. To more densely pack connectors 902 next to each other, the typical third and fourth threaded holes of conventional arrangements are omitted in the area between connectors 902. Typically, such an alternative plate configuration would require conventional cable retaining assemblies having two different configurations. The D-shell of each parallel connector 902 prevents conventional cable retaining assemblies from being flipped over into an improper orientation. Unfortunately, such alternative plate configurations undesirably increase the number of cable types that must be kept in inventory. The cable retaining assembly of the present invention, however, solves this problem by allowing the retention block to be flipped over while maintaining the connection block in the correct orientation. Thus, the same cable retaining assembly may be used for connection and retention to either of parallel connectors 902.

Two cable retaining assemblies 910 are shown in FIG. 9, one for each of parallel connectors 902. Each cable retaining assembly 910 includes a cable 912, a connector block 914 and a rotatable retention block 916 with a threaded fastener 918. Connector block 914 has a connector 920 housed in an overmold jacket 922 and connectable to the plate's connectors 902. Each connector 920 is a parallel connector having an internal structure 924 which carries thereon a plurality of electrical contacts 926 spaced and sized to make contact with electrical contacts (not shown) in a corresponding structure of the plate's connectors 902.

Each cable retaining assembly 910 is positioned to align its connector 920 for connection to the plate's connector 902. The retention block 916 of each cable retaining assembly 910 is rotated to align its threaded fastener 918 with respect to a corresponding one of the plate's threaded holes 906. Once aligned, each threaded fastener 918 is threaded into hole 906 to maintain a reliable, continuous connection. Thus, by rotating retention block 916, the same cable retaining assembly 910 may be used for connection and retention to either of parallel connectors 902.

While this invention has been described with respect to the preferred and alternative embodiments, it will be understood by those skilled in the art that various changes in detail may be made therein without departing from the spirit, scope, and teaching of the invention. Accordingly, the herein disclosed invention is to be limited only as specified in the following claims.

What is claimed is:

1. A cable connector retaining assembly, comprising:

a connector assembly;

a cable terminated in the connector assembly;

the connector assembly, comprising:

a connector block having a connector at least partially housed in an overmold jacket;

a retention block rotatably mounted to the overmold jacket to a plurality of selected positions relative to the overmold jacket and receives a portion of the overmold jacket therein, and having a connector retention fastener which is cooperatable with a connector retention feature to retain the retention block in a predefined one of the plurality of positions.

2. The cable connector retaining assembly as recited in claim 1, wherein the connector retention fastener includes at least one of a threaded fastener and a snap-in fastener.

3. The cable connector retaining assembly as recited in claim 1, wherein the overmold jacket includes a sleeve portion through which the cable passes, and wherein the retention block includes a first hole that rotatably receives the sleeve portion of the overmold jacket.

4. The cable connector retaining assembly as recited in claim 3, wherein the sleeve portion of the overmold jacket includes a groove that receives and rotatably secures a raised area of the first hole of the retention block.

5. The cable connector retaining assembly as recited in claim 3, wherein the connector retention fastener includes a threaded fastener, the retention block includes a second hole extending in a direction parallel to the first hole, and the second hole rotatably receives the threaded fastener.

6. The cable connector retaining assembly as recited in claim 1, wherein at least a portion of the overmold jacket and the retention block is at least one of molded, machined and extruded.

7. The cable connector retaining assembly as recited in claim 6, wherein at least a portion of the overmold jacket and the retention block is a molded polymeric material.

8. The cable connector retaining assembly as recited in claim 1, wherein the connector is at least one of a fiber optic cable connector and an electronic cable connector.

9. The cable connector retaining assembly as recited in claim 8, wherein the connector is an electronic cable connector selected from the group consisting of a universal serial bus (USB)-type connector, a parallel connector, and a serial connector.

10. The cable connector retaining assembly as recited in claim 9, wherein the connector is a USB-type connector.

11. A cable connector retaining system, comprising:

a plate having a first connector mounted thereon and a connector retention feature positioned adjacent to the first connector;

a cable connector retaining assembly, comprising:

a connector assembly;

a cable terminated in the connector assembly;

the connector assembly, comprising:

a connector block having a second connector at least partially housed in an overmold jacket and connectable to the first connector;

a retention block rotatably mounted to the overmold jacket, wherein the retention block receives a portion of the overmold jacket; and having a connector retention fastener engageable with the connection retention feature of the plate.

12. The cable connector retaining system as recited in claim 11, wherein the connector retention fastener includes a threaded fastener, and the connector retention feature of the plate includes a threaded hole that receives the treaded fastener.

13. The cable connector retaining system as recited in claim 11, wherein the connector retention fastener includes a snap-in fastener, and the connector retention feature of the plate includes a hole that receives the snap-in fastener.

14. The cable connector retaining system as recited in claim 11, wherein the overmold jacket includes a sleeve portion through which the cable passes, and wherein the retention block includes a first hole that rotatably receives the sleeve portion of the overmold jacket.

15. The cable connector retaining system as recited in claim 14, wherein the sleeve portion of the overmold jacket includes a groove that receives and rotatably secures a raised area of the first hole of the retention block.

16. The cable connector retaining system as recited in claim 14, wherein the connector retention fastener of the retainer block includes a threaded fastener, the retention block includes a second hole extending in a direction parallel to the first hole, and the second hole rotatably receives the threaded fastener.

17. The cable connector retaining system as recited in claim 11, wherein at least a portion of the overmold jacket and the retention block is at least one of molded, machined and extruded.

18. The cable connector retaining system as recited in claim 17, wherein at least a portion of the overmold jacket and the retention block is a molded polymeric material.

19. The cable connector retaining system as recited in claim 11, wherein the first and second connectors are at least one of fiber optic cable connectors and electronic cable connectors.

20. The cable connector retaining system as recited in claim 19, wherein the first and second connectors are electronic cable connectors selected from the group consisting of universal serial bus (USB)-type connectors, parallel connectors, and serial connectors.

21. The cable connector retaining system as recited in claim 20, wherein the first and second connectors are USB-type connectors.

22. A method of assembling a cable connector retaining system, comprising the steps of:

providing a plate having a first connector mounted thereon and a connector retention feature positioned adjacent to the first connector;

providing a cable connector retaining assembly, comprising:

a connector assembly;

a cable terminated in the connector assembly; the connector assembly, comprising:

a connector block having a second connector at least partially housed in an overmold jacket;

a retention block rotatably mounted to the overmold jacket and receives a portion of the overmold jacket, and having a connector retention fastener;

positioning the second connector for connection to the first connector;

moving the retention block relative to the overmold jacket to align the connector retention fastener with respect to the connector retention feature of the plate;

engaging the connector retention fastener with the connector retention feature of the plate.

23. The method of assembling a cable connector retaining system as recited in claim 22, wherein the connector retention fastener includes a threaded fastener and the connector retention feature of the plate includes a threaded hole, and wherein the engaging step includes the step of threading the threaded fastener into the threaded hole.

* * * * *